US007513360B1

(12) United States Patent
Bravo Lyon

(10) Patent No.: US 7,513,360 B1
(45) Date of Patent: Apr. 7, 2009

(54) SYSTEM AND METHOD FOR BALING A STACK OF SHEETS

(76) Inventor: Ricardo Guillermo Bravo Lyon, Avenlda Providencia 565, Oficina 12, Providoncia, Santiago (CL)

( * ) Notice: Subject to any disclaimer, the term of this patent is extended or adjusted under 35 U.S.C. 154(b) by 0 days.

(21) Appl. No.: 12/050,271

(22) Filed: Mar. 18, 2008

(51) Int. Cl.
*B65D 71/00* (2006.01)
*B65B 13/02* (2006.01)

(52) U.S. Cl. ..... 206/83.5; 100/3

(58) Field of Classification Search ..... 206/83.5, 206/445, 499; 53/203, 399, 441, 461, 556, 53/586; 100/1–3, 5, 7, 8, 34; 428/2, 571, 428/576, 583, 594
See application file for complete search history.

(56) References Cited

U.S. PATENT DOCUMENTS 2,400,197 A * 5/1946 Grodin ..... 100/1
3,906,591 A * 9/1975 Boiradi ..... 206/83.5
4,501,356 A * 2/1985 Urban et al. ..... 206/83.5
4,577,752 A * 3/1986 Meredith, Jr. ..... 206/83.5
4,746,011 A * 5/1988 McNair et al. ..... 206/83.5
5,845,768 A * 12/1998 Simpson ..... 206/83.5

* cited by examiner

*Primary Examiner*—Luan K Bui
(74) *Attorney, Agent, or Firm*—Eric Hanscom; Todd Langford

(57) ABSTRACT

A system and method for manipulating metal sheets for stacking, baling, and transporting is disclosed. Holding straps that are used to secure the metal sheets together are prevented from loosening or becoming dislodged from the bale of metal sheets during transportation. Flat and corrugated plates are deformed and stacked in such a manner that the shape of the plates in conjunction with the holding straps resists the flattening of the bale and lateral movement of the holding straps. The corrugation in metal sheets is used to aid in melting the sheets for use at its destination. This system and method creates a bale of stacked metal sheets that is more easily and economically transported from one location to another yet retains its efficient melting properties.

18 Claims, 4 Drawing Sheets

Prior Art

SYSTEM AND METHOD FOR BALING A STACK OF SHEETS

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the Invention

This invention relates to the general field of baling and transporting sheets of material, and more specifically toward a system and method for manipulating metal sheets for stacking, baling, and transporting. Holding straps that are used to secure the metal sheets together are prevented from loosening or becoming dislodged from the bale of metal sheets during transportation. Flat and corrugated plates are deformed and stacked in such a manner that the shape of the plates in conjunction with the holding straps resists the flattening of the bale and lateral movement of the holding straps. The corrugation in metal sheets is used to aid in melting the sheets for use at its destination. This system and method creates a bale of stacked metal sheets that is more easily and economically transported from one location to another yet retains its efficient melting properties.

Various refining techniques of metal ore, such as electrorefining or electrolysis, can result in the production of highly pure sheets of metal. These sheets of metal are generally about 1 meter wide by 1 meter long and are usually about 1 centimeter thick. For example, electrolysis can be used to process blistered copper into sheets that are upwards of 99.99% pure copper. Anodes cast from blistered copper are placed in a solution of 3-4% copper sulfate and 10-16% sulfuric acid. Thin sheets of highly pure copper cathodes are placed in the solution. When a potential of at least 0.2-0.4 volts is used, copper ions migrate through the solution to the cathode, thereby creating sheets of highly pure metal copper. These 1 meter by 1 meter by 1 centimeter sheets have a mass of around 100 kg.

It is possible to bale the metal sheets by stacking the sheets and binding them together with holding straps to transport them; however, this can make it difficult for a user to melt the sheets for his or her use. To aid in the melting process, some of the sheets are corrugated and placed in between the flat sheets. When melting an entire bale, melted metal is allowed to travel between the sheets thereby increasing the speed and efficiency in which the entire bale can be melted. While the corrugated sheets may allow the entire bale to be melted faster, the corrugated sheets also cause difficulties in storing and transporting the bale. Over time, the corrugated sheets can become partially or fully flattened by the weight of the bale itself or possibly by other bales that are placed on top of it. When the corrugated sheets flatten, the perimeter of the bale is decreased. The holding straps that were secured tightly around the bale are now loose because of the decreased size of the bale. The metal sheets can come loose from the bale during transport due to the holding straps no longer being able to secure the sheets together, thereby causing the bale to become disassembled. This leads to increased transportation costs and liability for moving bales of metal sheets from one location to another. Further, there is an increased risk that impurities will contaminate the dislodged sheets.

The prior art has made several attempts to solve this problem. One such attempt known in the art focused on mechanical deformation of the sheets such that no holding straps were required to secure the bale together. However, because each metal sheet was required to be secured to another simply by its shape, it was difficult to remove individual sheets if so desired by the user. Another attempt known in the prior art focused on using brackets that clamped to the sheets and prevented the lateral movement of the holding straps when the straps became loose. However, adding the clamps to each bale increase the cost and time associated with baling a stack of metal sheets.

Thus there has existed a long-felt need for a system and method for stacking metal sheets that can quickly and easily be baled and then transported long distances and/or stored for long periods of time without becoming disassembled. The metal sheets should be manufactured in such a way that resists flattening of the sheets, resists loosening of the holding straps, and prevents lateral movement of the holding straps. Even if the bale becomes flattened over time, the holding straps should be prevented from moving laterally thereby maintaining the bale of metal sheets. The bale may include corrugated metal sheets to aid in melting. Additionally, the system and method for baling a stack of sheets should allow the user, when he or she chooses, to disassemble the bale and use sheets individually.

The current invention provides just such a solution by having a system and method for manipulating metal sheets for stacking, baling, and transporting. Holding straps that are used to secure the metal sheets together are prevented from loosening or becoming dislodged from the bale of metal sheets during transportation. Flat and corrugated plates are deformed and stacked in such a manner that the shape of the plates in conjunction with the holding straps resists the flattening of the bale and lateral movement of the holding straps. The corrugation in metal sheets is used to aid in melting the sheets for use at its destination. This system and method creates a bale of stacked metal sheets that is more easily and economically transported from one location to another yet retains its efficient melting properties.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

SUMMARY OF THE INVENTION

The current invention provides a system and method for baling a stack of metal sheets that resists flattening and loosening and lateral movement of the holding straps that keep the metal sheets secured together. This is achieved by deforming portions of both the flat and corrugated metal sheets such that the perimeter of the bale that the holding straps travel is less than the perimeter of the bale proximate to the holding straps. Further, the flat and corrugated metal sheets are deformed to resist flattening. The perimeter of the bale that the holding straps travel is less over deformations than over other parts of the sheets even if the bale flattens.

It is a principal object of the invention to provide a system and method for baling a stack of metal sheets that prevents the lateral movement of the holding straps that bind the metal sheets together.

It is another object of the invention to provide a system and method for baling a stack of metal sheets that includes corrugated metal sheets to allow for an end user to quickly and efficiently melt the bale of metal sheets.

It is an additional object of the invention to provide a system and method for baling a stack of metal sheets that resists the flattening of the corrugated sheets.

It is a further object of the invention to provide a system and method for baling a stack of metal sheets where the holding straps can be released to allow the removal of individual sheets from the bale.

It is a final object of this invention to provide a system and method for baling a stack of metal sheets where even if the corrugated sheets are flattened, the holding straps will not become loose enough to allow the bale of metal sheets to become disassembled.

While metal has been the material used to explain the system and method of the current invention, it is known by the inventor that the metal sheets can in fact be any sheet of material, which would comprise any material that would benefit from the current invention, including plastics.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
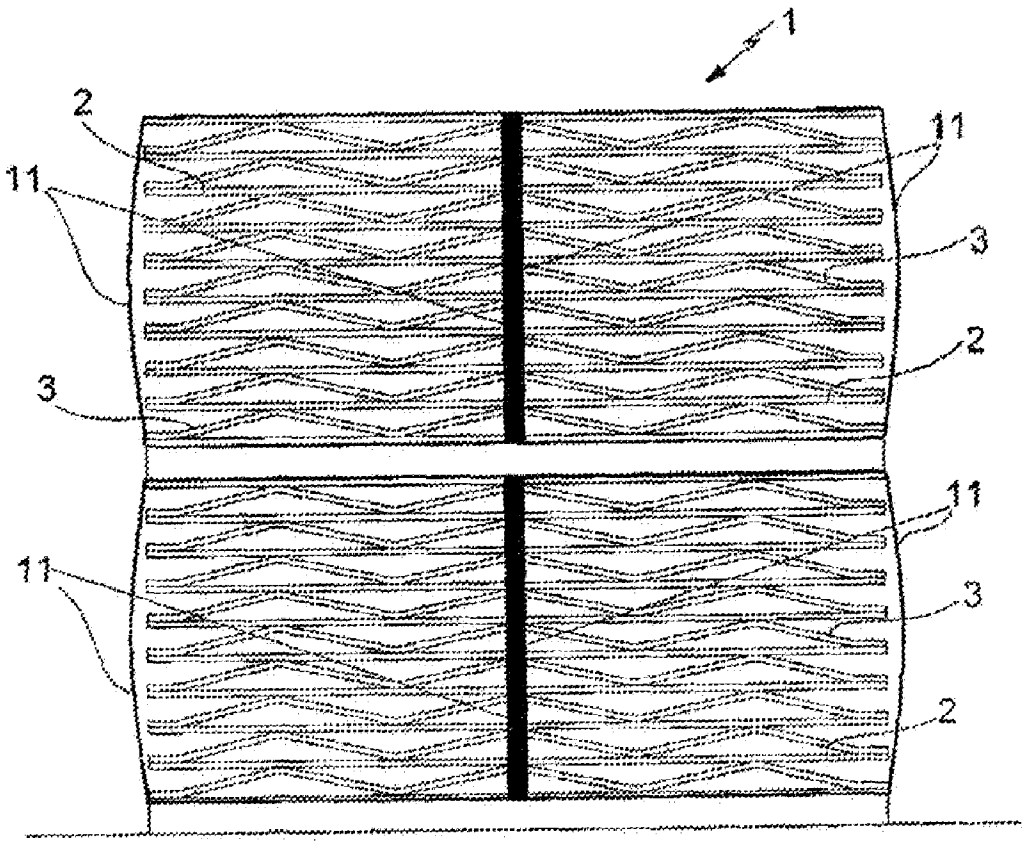
FIG. 1 is a side view of a prior art bale of metal sheets.

Many aspects of the invention can be better understood with reference to the drawings below. The components in the drawings are not necessarily drawn to scale. Instead, emphasis is placed upon clearly illustrating the components of the present invention. Moreover, like reference numerals designate corresponding parts through the several views in the drawings.

FIG. 1 is a side view of a prior art bale of metal sheets. In this figure, there are two bales of metal sheets 1, each stacked on top of the other. Each bale includes both flat metal sheets 2 and corrugated metal sheets 3. Under the weight of other metal sheets, the corrugated metal sheets 3 will, at least partially, flatten. This causes holding straps 11 to become loose. If a bale of metal sheets 1 is transported with loose holding straps 11, the bale can become disassembled leading to metal sheets dislodging from the bale. Not only can this lead to an added expense of correcting the disassembly, but the metal sheets themselves can also become contaminated with impurities from direct or indirect exposure to other materials.

Figure 2:
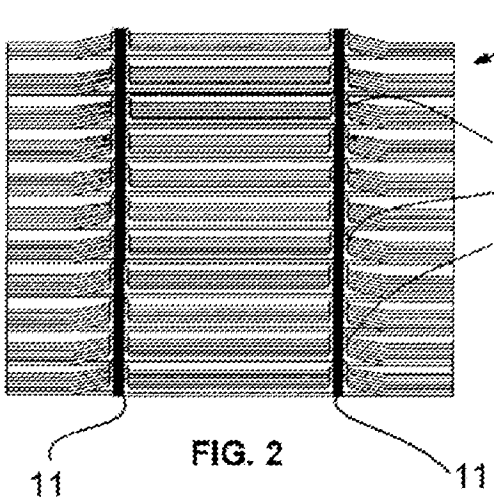
FIG. 2 is a front view of a bale of metal sheets according to the current invention.

FIG. 2 is a front view of a bale of metal sheets according to the current invention. The bale of metal sheets 1 includes deformations 4 along the sides of each sheet. The holding straps 11 fit into these deformations 4. The deformations 4 create a perimeter around the bale of metal sheets 1 that is less then in other locations of the bale of metal sheets 1, specifically locations that are adjacent to the deformations. Moving laterally away from the deformations requires a holding strap to encompass the larger perimeter of the bale of metal sheets 1. Therefore, the holding strap is prevented from moving laterally away from the deformations 4. This holds true even if the corrugated sheets are partially or fully flattened, as the perimeter of the bale of metal sheets 1 would be smaller directly over the deformations 4 and larger adjacent to the deformations 4.

Figure 3:
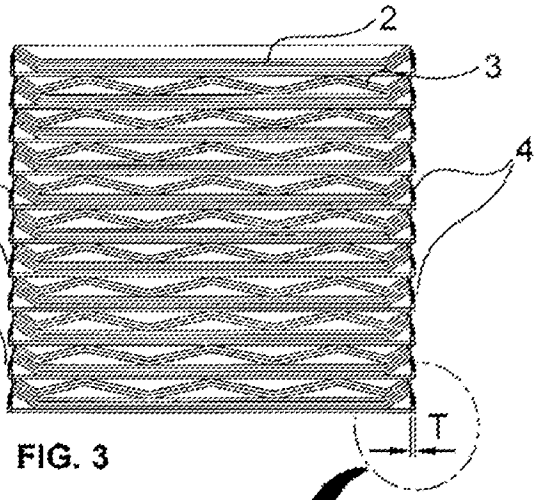
FIG. 3 is a cut-a-away side view of a bale of metal sheets according to the current invention.

FIG. 3 is a cut-a-way side view of a bale of metal sheets according to the current invention. In this embodiment, the bale of metal sheets 1 includes both flat metal sheets 2 and corrugated metal sheets 3. The deformations 4 allow a holding strap to travel a shorter distance around the bale of metal sheets. This is due to the width of the sheet being less at the point of deformation 4.

Figure 4:
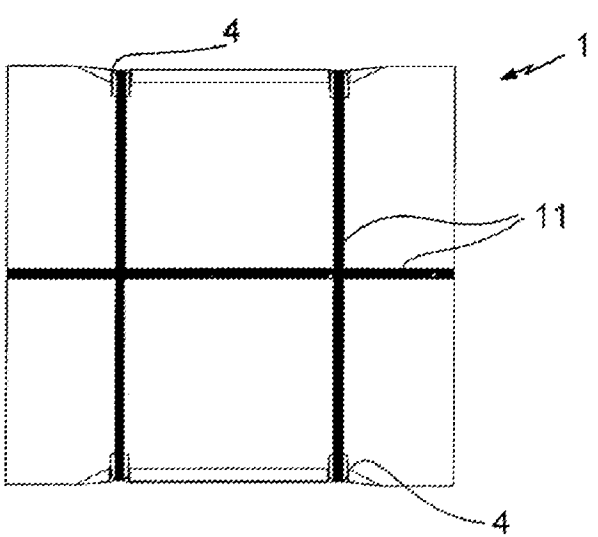
FIG. 4 is a top view of a bale of metal sheets according to the current invention.

FIG. 4 is a top view of a bale of metal sheets according to the current invention. The bale of metal sheets 1 is held together by holding straps 11. In this embodiment of the invention, there are three holding straps 11. Two of the holding straps 11 travel over deformations 4. The length of the metal sheets at the deformations 4 is less than the length where the metal sheets are not deformed thereby limiting the lateral movement of the holding strap. A third holding strap 11 is also included in this figure, but its movement is not restricted laterally if the corrugated metal sheets are flattened.

Figure 5:
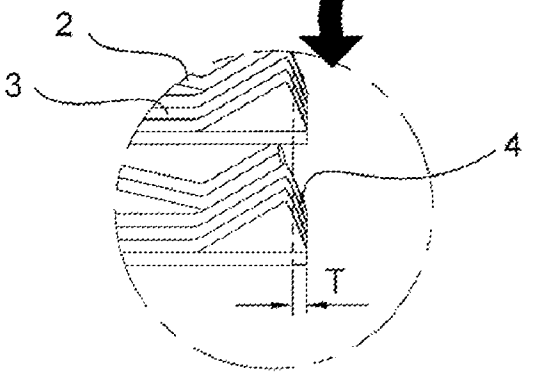
FIG. 5 is a detail view of the deformation zone shown in FIG. 3.

FIG. 5 is a detail view of the deformation zone shown in FIG. 3. The ends of the flat sheets 3 and the corrugated sheets 2 are bent to the same angle. The deformed portion 4 is bent back down. The formation of the flat sheets 3 and corrugated sheets 2 resists the flattening of the corrugated sheets 4 and loosening of the holding straps. As the corrugated sheets 2 are flattened, they push outwards on the flat sheets, which in turn push outwards on the holding straps. The holding straps restrict this movement and keep the flat sheet 3, and therefore the corrugated sheet 2 from pushing out. Additionally, deformations 4 add vertical support to assist in carrying the load of the sheets above and reduce stresses that cause flattening. The result is that the corrugated sheets 2 resist flattening, and any flattening that occurs has the result of tightening the holding straps.

Figure 6C:
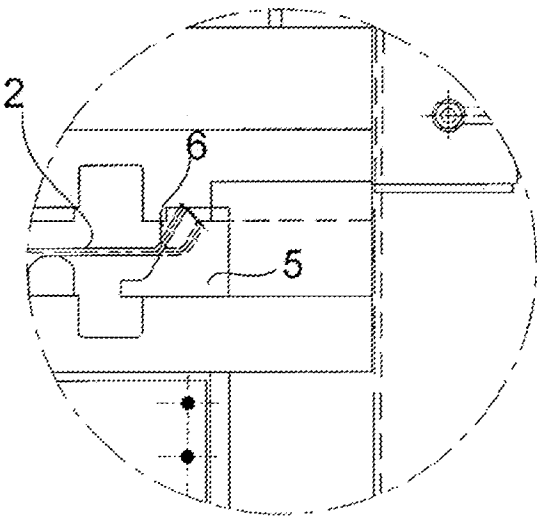
FIG. 6 shows a step-by-step process of the deformation of a flat metal sheet according to the current invention.
Figure 6B:
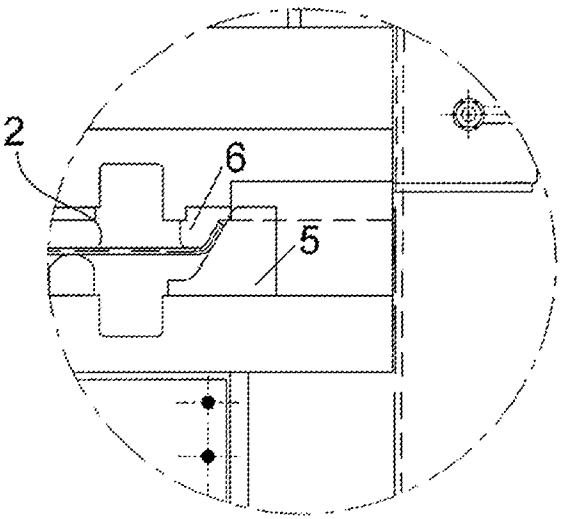
Figure 6A:
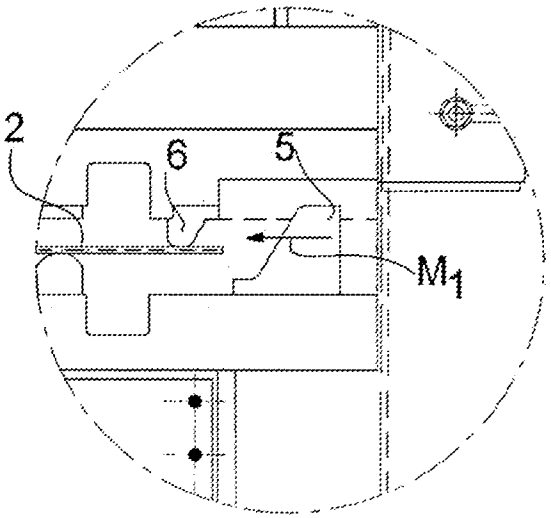

FIG. 6 shows a step-by-step process of the deformation of a flat metal sheet according to the current invention. FIG. 6A shows a flat metal sheet 2 before it has been deformed. A mobile deforming punch 5 is moved in the direction M1 towards a fixed die 6. As shown in FIG. 6B, the mobile deforming punch 5 causes the end of the flat metal sheet 2 to be bent upwards against the fixed die 6. The mobile deforming punch 5 continues in the direction M1 having the secondary effect of causing the upper lip of the flat metal sheet 2 to bend back down. This creates the unique design of an end of a flat metal sheet 2 as clearly shown in FIG. 5.

Figure 7C:
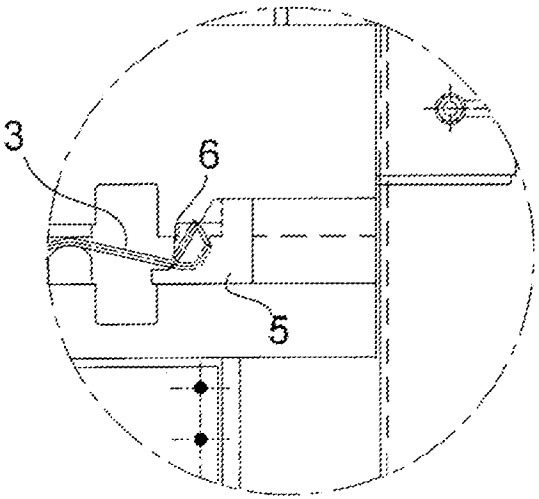
FIG. 7 shows a step-by-step process of the deformation of a corrugated metal sheet according to the current invention.
Figure 7B:
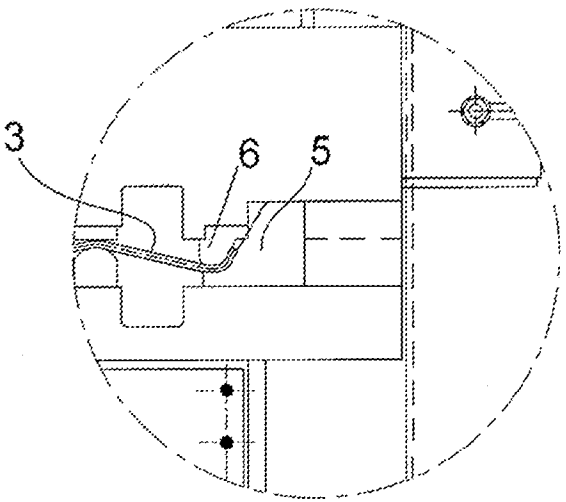
Figure 7A:
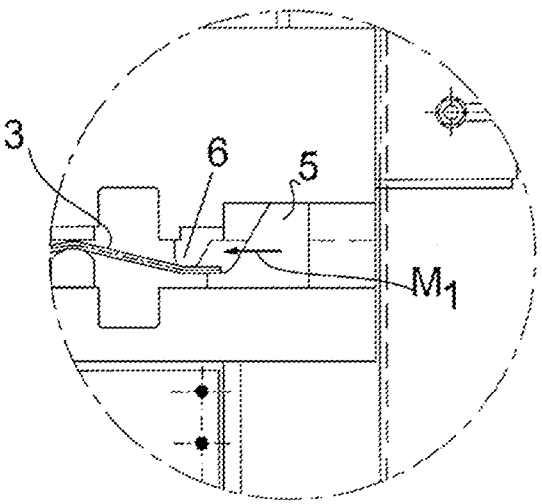

FIG. 7 shows a step-by-step process of the deformation of a corrugated metal sheet according to the current invention. FIG. 7A shows a corrugated metal sheet 3 before it has been deformed. A mobile deforming punch 5 is moved in the direction M1 towards a fixed die 6. As shown in FIG. 7B, the mobile deforming punch 5 causes the end of the corrugated metal sheet 3 to bend upward against the fixed die 6. The mobile deforming punch 5 continues in the direction M1 having the secondary effect of increasing the upward angle of the end of the sheet. This creates the unique design of an end of a corrugated metal sheet 3 as clearly shown in FIG. 5.

What I claim is:

1. A method for baling sheets of material comprising the steps of first, obtaining a plurality of sheets of material, second, corrugating more than one of the plurality of sheets of material, third, deforming the plurality of sheets of material, fourth, stacking the plurality of sheets of material together, and fifth, binding the plurality of sheets of material together using a plurality of holding straps to create a bale of the plurality of sheets of material, where the plurality of sheets comprise both flat sheets and the more than one corrugated sheets, where each of the plurality of sheets has a left side, right side, front side, back side, top, and bottom, where the plurality of sheets of material are stacked on top of each other to form a stack of sheets of material, where there is a sheet of material on top, a sheet of material on bottom, and sheets of material in between the top sheet of material and the bottom sheet of material, where the plurality of holding straps secure the plurality of sheets together to form the bale of stacked sheets of material, where the holding straps travel over the top of the top sheet of material, the bottom of the bottom sheet of material, and around opposing sides of all of the sheets of material, where at least one of the plurality of holding straps travels over deformations in each of the plurality of sheets of material, where there are deformations on opposite sides of each sheet of material such that if there is a deformation on the left side, there is a deformation on the right side and if there is a deformation on the front side, there is a deformation on the back side, where the width of each deformation is at least as wide as the width of a holding strap, where the deformations decrease the width of the sheet of material at the location of the deformation such that the perimeter that a holding strap must travel is less if it travels over the deformations than if it does not travel over the deformations thereby laterally restricting the movement of the holding straps.

2. The method of claim 1, where the combination of the deformations of the sheets of material, the stacking of the sheets of material, and the plurality of holding straps resist the flattening of the corrugated sheets.

3. The method of claim 1, where the sheets of material are metal sheets.

4. The method of claim 3, where the metal sheets are copper sheets.

5. The method of claim 1, where the second step comprises corrugating a plurality of sheets of material.

6. The method of claim 5, where the sheets of material are stacked together by alternating between the corrugated and flat sheets of material.

7. The method of claim 5, where the corrugated sheets of material are grouped into equal numbers and the flat sheets of material are grouped into equal numbers, where sheets of material are stacked together by alternating between groups of corrugated sheets of material and groups of flat sheets of material.

8. The method of claim 1, where, in the third step, the each sheet of material is deformed four times.

9. The method of claim 8, where the each sheet of material is deformed twice on one side and twice on the opposite side.

10. A bale of stacked sheets of material comprising a plurality of sheets of material and a plurality of holding straps, where the plurality of sheets comprise both flat sheets and corrugated sheets, where each of the plurality of sheets has a left side, right side, front side, back side, top, and bottom, where the plurality of sheets of material are stacked on top of each other to form a stack of sheets of material, where there is a sheet of material on top, a sheet of material on bottom, and sheets of material in between the top sheet of material and the bottom sheet of material, where the plurality of holding straps secure the plurality of sheets together to form the bale of stacked sheets of material, where the holding straps travel over the top of the top sheet of material, the bottom of the bottom sheet of material, and around opposing sides of all of the sheets of material, where at least one of the plurality of holding straps travels over deformations in each of the plurality of sheets of material, where there are deformations on opposite sides of each sheet of material such that if there is a deformation on the left side, there is a deformation on the right side and if there is a deformation on the front side, there is a deformation on the back side, where the width of each deformation is at least as wide as the width of a holding strap, where the deformations decrease the width of the sheet of material at the location of the deformation such that the perimeter that a holding strap must travel is less if it travels over the deformations than if it does not travel over the deformations thereby laterally restricting the movement of the holding straps.

11. The bale of stacked sheets of material of claim 10, where the holding straps are restricted from moving laterally even if the corrugated sheets are at least partially flattened.

12. The bale of stacked sheets of material of claim 10, where the corrugated sheets are fluted to aid in melting the bale of stacked sheets of materials.

13. The bale of stacked sheets of material of claim 10, where the sheets of material are metal.

14. The bale of stacked sheets of material of claim 13, where the metal sheets of material are copper metal sheets of material.

15. The bale of stacked sheets of material of claim 10, where there are a plurality of deformations on each of the two opposing sides of the sheet of material.

16. The bale of stacked sheets of material of claim 10, where the bale of stacked sheets of material alternates between groups of flat sheets of material and groups of corrugated sheets of material.

17. A bale of stacked metal sheets consisting of a plurality of sheets and three holding straps, where the plurality of metal sheets comprise both flat sheets and corrugated sheets, where each of the plurality of metal sheets has a left side, right side, front side, back side, top, and bottom, where the plurality of metal sheets are stacked on top of each other to form a stack of metal sheets, where there is a metal sheet on top, a metal sheet on bottom, and metal sheets in between the top metal sheet, and the bottom metal sheet, where the three holding straps secure the plurality of metal sheets together to form the bale of stacked metal sheets, where the holding straps travel over the top of the top metal sheet, the bottom of the bottom metal sheet, and around opposing sides of all of the metal sheets, where one holding strap travels over the front and back side of the metal sheets, while the remaining two holding straps travel over the left and right sides of the metal sheets, where the two holding straps travel over deformations in each of the plurality of metal sheets, where there are two sets of deformations on the left side and right side of each metal sheet such that the width of each deformation is at least as wide as the width of a holding strap, where the deformations decrease the width of the metal sheet at the location of the deformation such that the perimeter that a holding strap must travel is less if it travels over the deformations than if it does not travel over the deformations thereby laterally restricting the movement of the holding straps.

18. The bale of stacked metal sheets of claim 17, where the two holding straps that travel over the deformations also resist the flattening of the corrugated metal sheets.

* * * * *